US007631781B2

(12) United States Patent
Chen

(10) Patent No.: US 7,631,781 B2
(45) Date of Patent: Dec. 15, 2009

(54) DOUBLE-LAYERED ROTARY CUP

(76) Inventor: Tsan-Yao Chen, 2-1 Fl., No. 76 Sec. 3, Hsinsheng North Rd., Taipei City (TW)

( * ) Notice: Subject to any disclaimer, the term of this patent is extended or adjusted under 35 U.S.C. 154(b) by 219 days.

(21) Appl. No.: 11/970,531

(22) Filed: Jan. 8, 2008

(65) Prior Publication Data

US 2009/0173652 A1 Jul. 9, 2009

(51) Int. Cl.
*A47G 19/22* (2006.01)
*B65D 77/00* (2006.01)

(52) U.S. Cl. ..... 220/703; 206/217; 206/459.5

(58) Field of Classification Search ..... 206/217, 206/457, 459.5; 40/324, 427; D7/509, 511, D7/513, 516, 519; 220/703, 711, 62.14, 220/62.18, 212; 229/400, 404
See application file for complete search history.

(56) References Cited

U.S. PATENT DOCUMENTS 5,275,277 A * 1/1994 Gallegos ..... 206/217
5,525,383 A * 6/1996 Witkowski ..... 206/217
5,765,715 A * 6/1998 Hughes ..... 220/737
6,036,570 A * 3/2000 Nadel ..... 446/74
6,216,856 B1 * 4/2001 Park ..... 206/457
6,334,271 B1 * 1/2002 Su Yeh ..... 220/703
6,464,078 B1 * 10/2002 Grossnickle ..... 206/459.5
2005/0103794 A1 * 5/2005 Liu ..... 220/703

* cited by examiner

*Primary Examiner*—Luan K Bui
(74) *Attorney, Agent, or Firm*—Leong C. Lei

(57) ABSTRACT

A double-layered rotary cup includes an outer receptacle in which an inner container is received. The container has an open top along which a circumferential lip carrying a seal ring in an underside thereof is formed to be slidably positioned on a top rim of the receptacle. The bottom of the receptacle forms a hole through which a bolt extends to engage an internally-threaded projection formed on the bottom of the container thereby forming a relatively rotatable configuration between the receptacle and the container. A spring biased positioner is arranged between the bottoms of the container and the receptacle for setting the relative angular position therebetween. Films on which patterns are printed are attached to an outside surface of the container and an inside surface of the receptacle and the film of the receptacle forms windows for exposing the patterns of the film of the container.

4 Claims, 4 Drawing Sheets

DOUBLE-LAYERED ROTARY CUP

BACKGROUND OF THE INVENTION (a) Technical Field of the Invention

The present invention relates to a double-layered cup having inner and outer containers that are of relative rotation with respect to each other and carrying films that have patterns formed thereon to exhibit the patterns and combinations thereof when relative rotation is performed between the inner and outer containers.

(b) Description of the Prior Art

A conventional cup is a utility utensil that is used for drinking water or other liquid foods. The conventional cups all of the same function of drinking, although they may have a variety of different shapes and configurations and may be made of various materials, such as plastics and glass, or may carry different decorations, such as paintings that are formed on a mug or printings provided on plastic cup, which are simply for aesthetics and consumer appealing.

Heretofore, improvement on the functionality of the cup are very rear and thus the variation of the shape of cups and the decoration that provided on the outside surface of the cups are constrained from further improvement or modification. Apparently, any new configuration and more creative decoration that are provided for cups do not make any appealing to the general consumers and the cups cannot be a product of fashion.

In view of these problems, particularly shaped cups are developed, which comprises a cup body to which a doll or a figure or model of animal or cartoon figure is added in a three-dimensional configuration, aiming to provide more versatile variation of the cup configuration. Such a cup is formed by directly fitting the doll or animal model over an outer circumference of the cup, and thus providing no function improvement. Apparently, there is not much improvement for market acceptability.

It is desired to have an improvement over the conventional cups to overcome the above problems.

SUMMARY OF THE INVENTION

The primary purpose of the present invention is to provide a double-layered rotary cup comprising an inner container and an outer receptacle that are fit together and coupled to each other in a relatively rotatable manner.

In accordance with the present invention, a double-layered rotary cup is provided, comprising an outer receptacle and an inner container fit into and received in the outer receptacle, wherein the outer receptacle has a top rim that supports a circumferential lip formed along an open top of the inner container with a rotation seal ring interposed therebetween to thereby form a rotary coupling therebetween and wherein the outer receptacle has a bottom through which a bolt extends to engage an internally-threaded projection formed on the bottom of the inner container to further ensure the rotatable coupling between the inner container and the outer receptacle.

Another objective of the present invention is to provide a double layer-rotary cup comprising an outer receptacle rotatably receiving therein an inner container, wherein the inner container comprises a spring biased positioner selectively engaging spaced cavities defined in the outer receptacle to selectively set the relative angular position between the outer receptacle and the inner container and wherein a bolt extends through a bottom of the receptacle and engages an internally-threaded projection of the inner container to selectively set resistance against the relative rotation.

A further objective of the present invention is to provide a double-layered rotary cup comprising an outer receptacle rotatably receiving an inner container therein, wherein the outer receptacle has an inner surface carrying a first sticker film on which delicate design of patterns is provided and the inner container has an outer surface carrying a second sticker film on which a delicate design of pattern is provided, whereby the relative rotation between the container and receptacle causes relative displacement between the patterns, which induces variation of observation of the patterns due. In accordance with the present invention, the delicate design of patterns of the first and second sticker films may be composed of different patterns, colors, texts, marks, signs and any combinations and derivates thereof.

In accordance with the present invention, the first sticker firm may form at least one window opening to expose partially the pattern of the second sticker film so that more versatile combination of the patterns can be realized through the relative rotation between the outer receptacle and inner container. Further in accordance with the present invention, the patterns can be of amusement or talent training purposes or combined with advertisement wording to enhance the value of the cup of the present invention.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
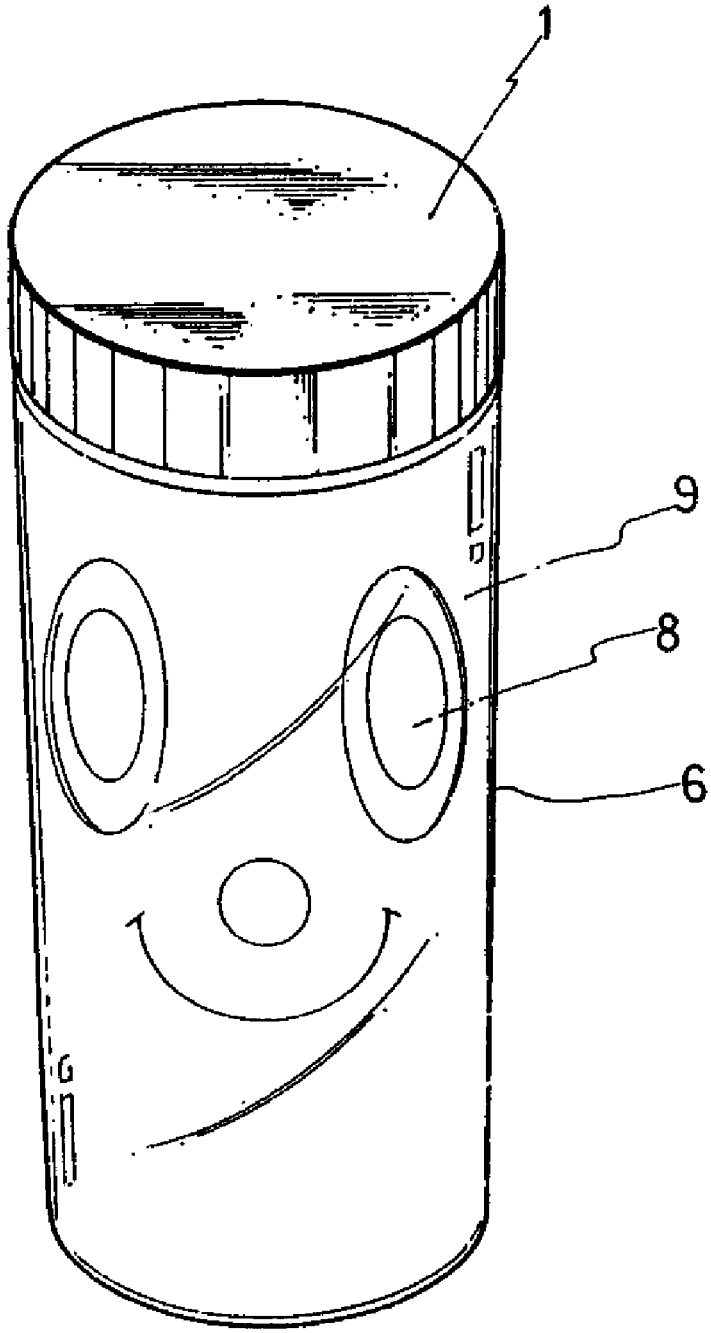
FIG. 1 is a perspective view showing a double-layered rotary cup constructed in accordance with the present invention.
Figure 2:
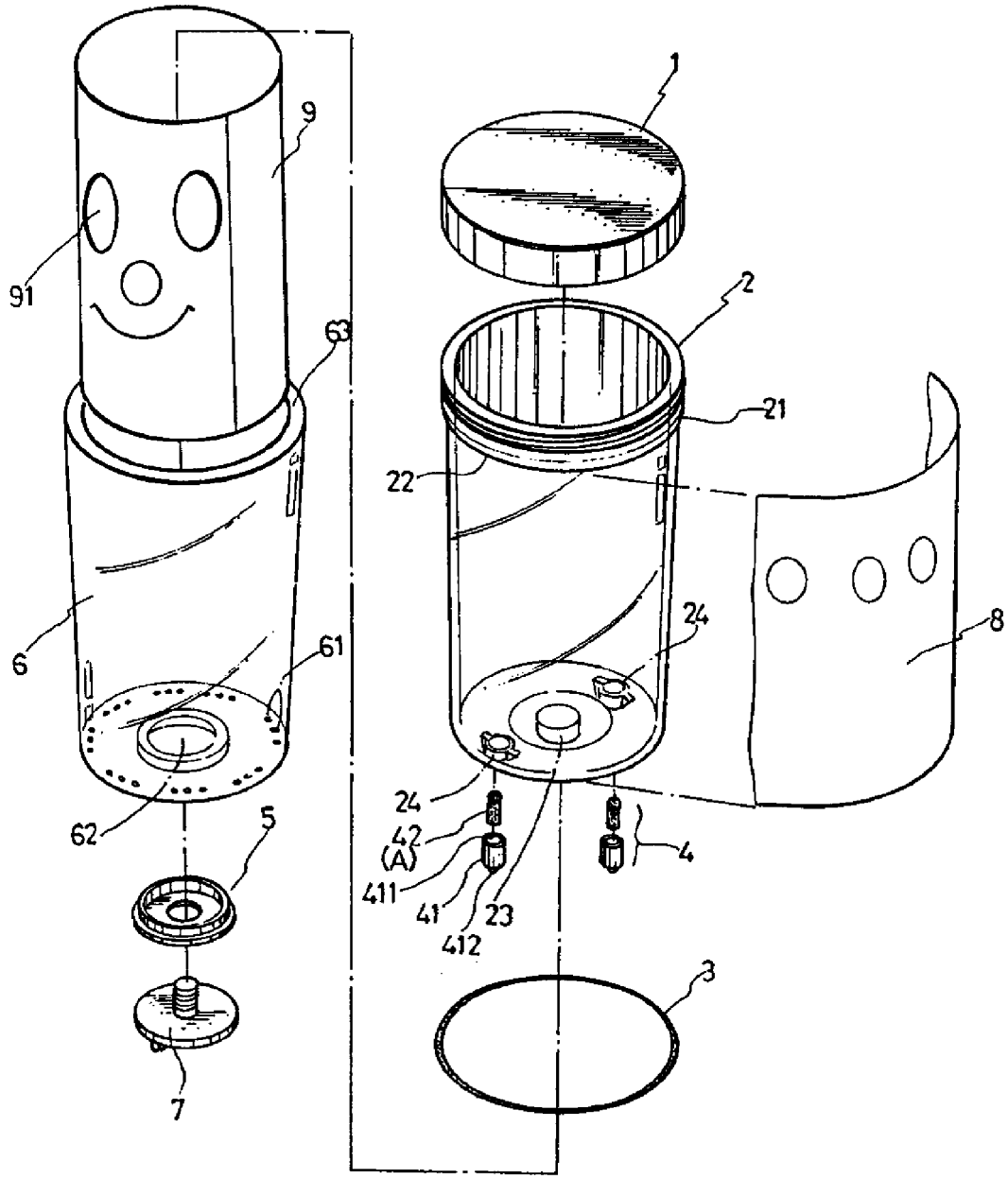
FIG. 2 is an exploded view of the double-layered rotary cup of the present invention.

With reference to the drawings and in particular to FIGS. 1 and 2, the present invention provides a double-layered rotary cup. The cup constructed in accordance with the present invention generally comprises a lid 1, an inner container 2, a seal ring 3, positioners 4, a retention disk 5, an outer receptacle 6, a coupling bolt 7 and sticker films 8, 9 respectively attached to an outer circumferential surface of the inner container and an inner circumferential surface of the outer receptacle. The lid 1 is removably mounted to a top opening of the inner container 2. A circumferential lip 21 is formed along an outer circumference of the top opening of the inner container 2. The lip 21 has an undersurface in which a slot 22 is formed for receiving the seal ring 3 therein that provides a sealed, leakage-proof engagement with a top opening of the outer receptacle 6 and forms a rotary structure.

The inner container 2 is a top-opened container having a closed bottom. In an undersurface of the bottom of the inner container 2, an internally-threaded projection 23 is formed. Also formed in the undersurface of the bottom of the inner container 2 are a plurality of positioner seats 24 for receiving and retaining the positioners 4 therein to correspond to positioning cavities 61 defined in an inside surface of the bottom of the outer receptacle 6.

Figures 3, 4, 5:
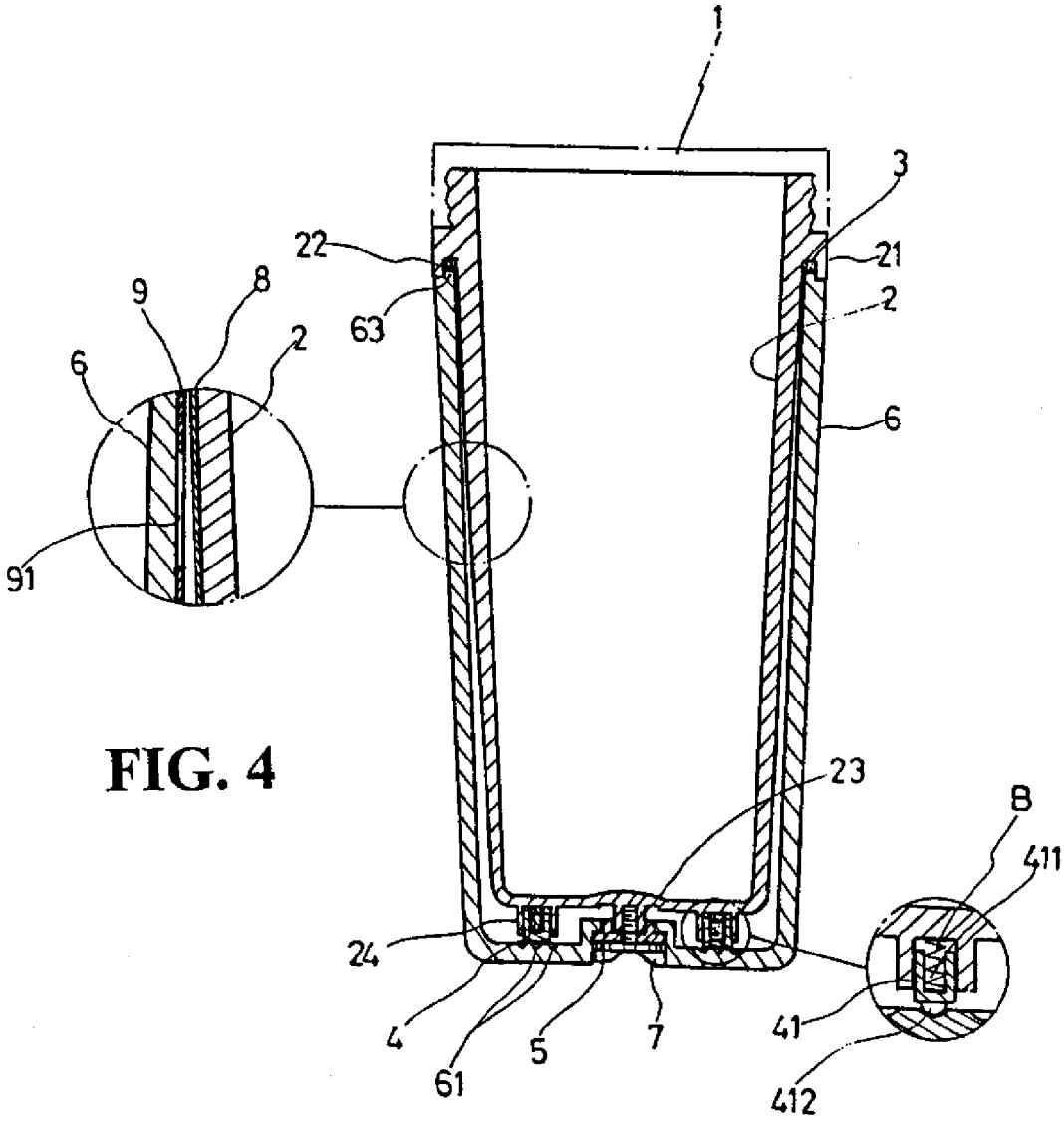
FIG. 3 is a cross-sectional view of the double-layered rotary cup of the present invention.
FIG. 4 is an enlarged view of a portion of the double-layered rotary cup.
FIG. 5 is an enlarged view of a circled portion of the double-layered cup of FIG. 3, illustrating a positioner of the cup in accordance with another embodiment of the present invention.

Also referring to FIG. 3, each positioner 4 comprises an inner sleeve 41 and a resilient element 42. The inner sleeve 41 forms a bore 411 in which the resilient element 42 is received and retained. The inner sleeve 41 has a closed bottom that forms an outward-projecting positioning bead 412, which is biased by the spring force of the resilient element 42 to selectively engage positioning cavities 61 with the rotation of the outer receptacle 6 to thereby set the outer receptacle 6 at a selected angular position with respect to the inner container 2. Further, the resilient element 42 of the positioner 4 can be a flexible rubber object (A) or, as shown in FIG. 5, can be a spring (B). Both are capable to realize the same function.

As shown in FIGS. 2 and 3, the coupling bolt 7 extends through the centrally-bored retention disk 5, which is fit in a receiving hole 62 defined in the bottom of the outer receptacle 6, to threadingly engage the internally-threaded projection 23 formed on the under surface of the bottom of the inner container 2. Tightness of the threading engagement sets the rotation resistance between the inner container 2 and the outer receptacle 6. Thus, an optimum rotation resistance can be set by means of the coupling bolt 7. Further, the outer receptacle 6 is coupled to the inner container 2 by means of a top rim 63 of the top opening thereof that corresponds to the slot 22 formed in the undersurface of a circumferential lip 21 of the opening of the inner container 2 and the coupling bolt 7 that threadingly engages the inner container 2 so that the outer receptacle 6 provides a rotatable and pivotally coupled configuration with respect to the inner container 2.

Figure 6:
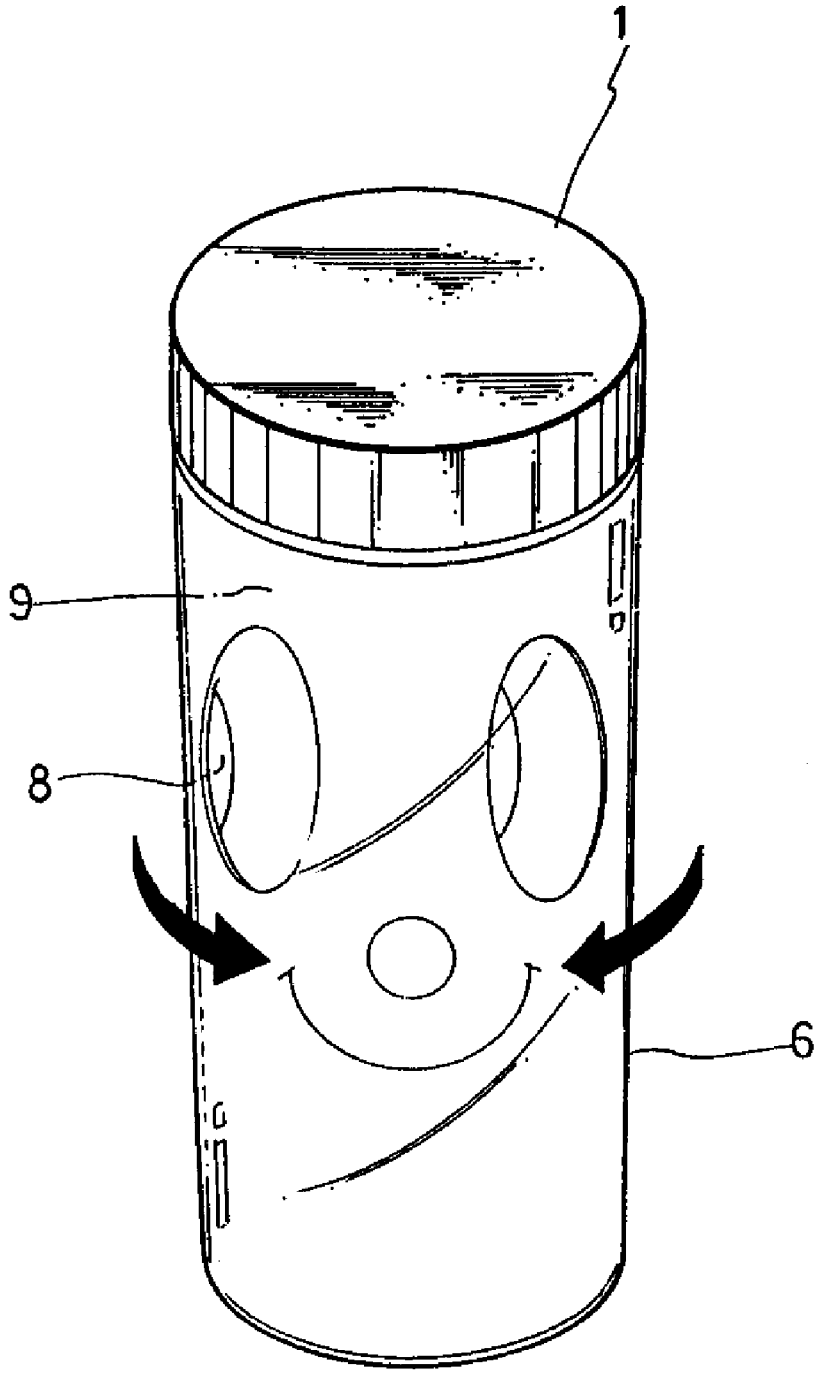
FIG. 6 is a perspective view illustrating the operation of the double-layered rotary cup of the present invention.

Also referring to FIGS. 2, 4, and 6, the sticker films 8, 9 that are attached to the outer circumference surface of the inner container 2 and the inner circumferential surface of the outer receptacle 6 are formed with patterns, colors, texts, marks, sings or any combination thereof. When the outer receptacle 6 is rotated with respect to the inner container 2, the sticker film 9 that is attached to the outer receptacle 6 forms at least one opening or window 91 to allow observation of the sticker film 8 attached to the inner container 2 so that rotation induced position-shifting may occur between the sticker films 8, 9. If the patterns of the sticker films 8, 9 are of proper designs, then sequential variation of a series of patterns can be realized to provide enhance amusement.

Although the present invention has been described with reference to the preferred embodiment thereof it is apparent to those skilled in the art that a variety of modifications and changes may be made without departing from the scope of the present invention which is intended to be defined by the appended claims.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A double-layered rotary cup comprising a lid, an inner container, a seal ring, at least one positioner, a retention disk, an outer receptacle, a coupling bolt, and sticker films respectively attached to an outer circumferential surface of the inner container and an inner circumferential surface of the outer receptacle, and characterized in that:

the inner container having the outer circumferential surface to which a first one of the sticker films is attached and also having a closed bottom having an undersurface in which an internally-threaded projection for threading engagement with the coupling bolt and a positioner seat corresponding to and receiving each positioner therein so that the positioner correspond to and is selectively engageable with positioning cavities defined in an inside surface of a bottom of the outer receptacle; and the outer receptacle having the inner circumferential surface to which a second one of the sticker films is attached, the second one of the sticker films forms at least one window, the bottom of the outer receptacle forming a receiving hole that receives the retention disk that is centrally bored for extension of the coupling bolt to engage the internally-threaded projection of the inner container, the outer receptacle having a top opening having a rim that corresponds to a slot defined in an undersurface of a circumferential lip formed along an outer circumference of a top opening of the inner container and receiving the seal ring therein.

2. The double-layered rotary cup as claimed in claim 1, wherein the sticker films are formed with patterns, colors, texts, marks, signs or combinations thereof.

3. The double-layered rotary cup as claimed in claim 1, wherein the seal ring interposed between the circumferential lip of the inner container and the rim of the outer receptacle provides a sealing engagement therebetween and allows relative rotation between the inner container and the outer receptacle.

4. The double-layered rotary cup as claimed in claim 1, wherein the positioner comprise a sleeve forming a bore and having a closed bottom, a resilient element being received in the bore, the bottom having an outward-projecting positioning bead engageable with the cavities defined in the outer receptacle.

* * * * *